US006817841B2

(12) United States Patent
Frank et al.

(10) Patent No.: US 6,817,841 B2
(45) Date of Patent: Nov. 16, 2004

(54) HIGH-PRESSURE FUEL PUMP FOR INTERNAL COMBUSTION ENGINE WITH IMPROVED PARTIAL-LOAD PERFORMANCE

(75) Inventors: Kurt Frank, Schorndorf (DE); Steffen Jung, Leonberg (DE); Andreas Kellner, Moeglingen (DE); Vincenzo Damiani, Bari (IT); Domenico Maldera, Corato (IT); Davide Olieveri, Bari (IT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/164,582

(22) Filed: Jun. 10, 2002

(65) Prior Publication Data

US 2002/0189436 A1 Dec. 19, 2002

(30) Foreign Application Priority Data

Jun. 19, 2001 (DE) ..... 101 29 449

(51) Int. Cl.[7] ..... F04B 1/04; F04B 7/00

(52) U.S. Cl. ..... 417/273; 417/512

(58) Field of Search ..... 417/273, 269, 417/470, 266, 554, 512; 91/474, 477, 476, 490, 226, 228, 234; 123/495, 458, 446, 457

(56) References Cited

U.S. PATENT DOCUMENTS

| | | | | | |
|---|---|---|---|---|---|
| 2,827,859 | A | * | 3/1958 | Crane | 103/161 |
| 3,519,370 | A | * | 7/1970 | Bieuel | 103/5 |
| 3,682,572 | A | * | 8/1972 | Yarger | 417/273 |
| 4,709,673 | A | * | 12/1987 | Babitzka | 123/299 |
| 4,767,288 | A | * | 8/1988 | Straubel | 417/462 |
| 5,354,183 | A | * | 10/1994 | Eisenbacher et al. | 417/366 |
| 5,383,770 | A | * | 1/1995 | Hisahara et al. | 417/273 |
| 5,511,956 | A | * | 4/1996 | Hasegawa et al. | 417/271 |
| 5,876,186 | A | * | 3/1999 | Stiefel | 417/273 |

* cited by examiner

*Primary Examiner*—Charles G. Freay
(74) *Attorney, Agent, or Firm*—Ronald E. Greigg

(57) ABSTRACT

A fuel injection system in which only one pump element at a time can aspirate fuel. As a result, it is attained that even in partial-load operation, all the pump elements are in operation, and as a consequence the smooth operation of the engine in partial-load operation is improved.

17 Claims, 3 Drawing Sheets

HIGH-PRESSURE FUEL PUMP FOR INTERNAL COMBUSTION ENGINE WITH IMPROVED PARTIAL-LOAD PERFORMANCE

BACKGROUND OF THE INVENTION

1. Field of the Invention

The invention relates to a radial piston pump for high-pressure fuel supply in fuel injection systems of internal combustion engines, in particular in a common rail injection system, having a plurality of pump elements, disposed radially to a drive shaft, each of the pump elements having a pumping chamber that is defined on one end by a piston, having one intake-side inlet conduit per pump element, wherein the inlet conduits are supplied with fuel via an annular conduit, defined by the drive shaft and a housing, and discharge into the pumping chambers of the pump elements.

2. Description of the Prior Art

In radial piston pumps of the type with which this invention is concerned, the pumping quantity is as a rule controlled by means of intake throttling. If two pump elements are simultaneously aspirating fuel from the annular conduit, then at low feed quantities, especially feed quantities of less than 30% of the full feed quantity, it can happen that one of the pump elements will fail completely and not pump any longer. This leads to an unequal demand for torque by the high-pressure fuel pump and hence to rough operation of the engine. This rough operation of the engine is especially problematic in idling.

It is known to overcome this for instance by means of a controlled intake valve, in which the spring of the intake valve is disposed in the piston of the pump element. A disadvantage of this embodiment is the increased idle space and the poorer efficiency and the size of the high-pressure fuel pump.

Another way of solving this problem could be to provide one metering unit per pump element, instead of one metering unit for the entire high-pressure fuel pump. This solution fails, however, among other reasons because of high costs and the space needed for additional metering units.

OBJECT AND SUMMARY OF THE INVENTION

The primary object of the invention is to furnish a high-pressure fuel pump in which the pump elements pump uniformly even in the partial-load range and which compared with known high-pressure fuel pumps requires no additional structural volume and moreover can be produced extremely economically.

In a radial piston pump for high-pressure fuel supply in fuel injection systems of internal combustion engines, in particular in a common rail injection system, having a plurality of pump elements, disposed radially to a drive shaft, each of the pump elements having a pumping chamber that is defined on one end by a piston, having one intake-side inlet conduit per pump element, wherein the inlet conduits are supplied with fuel via an annular conduit, defined by the drive shaft and a housing, and discharge into the pumping chambers of the pump elements, this object is attained in that the hydraulic communication between the annular conduit and the inlet conduits is controlled by the drive shaft.

Because of the control according to the invention of the hydraulic communication between the annular conduit and inlet conduits, it is assured that at all times, that is, in every position of the drive shaft, only one pump element can aspirate fuel from the annular conduit. Thus in the partial-load range, this prevents the possibility of a plurality of pump elements aspirating simultaneously, so that one of these pump elements can no longer aspirate any fuel at all and hence can no longer pump any fuel. In the high-pressure fuel pump of the invention, each pump element, during its intake stroke, can aspirate the entire fuel quantity flowing through the metering unit into the annular conduit. Therefore even in the partial-load range, where feed quantities are very slight, the pump elements still function well. The torque required by the high-pressure fuel pump is therefore virtually constant over one revolution of the drive shaft, and thus the internal combustion engine still operates smoothly even during idling.

In a further feature of the invention, it is provided that the drive shaft is embodied as a rotary slide, so that the control of the hydraulic communication between the annular conduit and the inlet conduits can be done in the simplest possible way, virtually without needing additional space. Depending on how the rotary slide is designed, the control times can be adapted in a simple way to the requirements of the fuel injection system.

In another feature of the invention, it is provided that during the intake stroke of a pump element, this element communicates hydraulically with the annular conduit, and/or that regardless of the position of the drive shaft, only one inlet conduit is ever in hydraulic communication with the annular conduit at a time, so that only one pump element at a time can aspirate the entire fuel quantity flowing into the annular conduit, and as a result optimal intake conditions for the pump elements prevail.

Alternatively, it can also be provided that regardless of the position of the drive shaft, at least one inlet conduit does not communicate hydraulically with the annular conduit. This means that a plurality of inlet conduits, but not all the inlet conduits, communicate simultaneously with the annular conduit, which makes the pumping flow of the prefeed pump more uniform without having to do without the advantages of the invention in terms of the operating performance of the high-pressure fuel pump.

Another feature of the invention provides that the fuel inflow in the annular conduit is controlled by a metering unit, so that the feed quantity regulation of the high-pressure fuel pump of the invention can be accomplished in a time-tested way that is known per se.

To prevent a reverse flow of fuel out of the pump element into the annular conduit, a check valve is disposed in each inlet conduit.

To increase the operating reliability and to simplify production, it is also provided that the inlet conduits are disposed in the housing; in an especially preferred embodiment, the inlet conduits extend essentially radially to the longitudinal axis of the drive shaft.

In a further feature of the invention, it is provided that the annular conduit is sealed off from the lubrication of the high-pressure fuel pump, so that the pump element cannot aspirate any fuel that is meant to serve solely to lubricate the high-pressure fuel pump, thus making precise feed quantity regulation possible.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
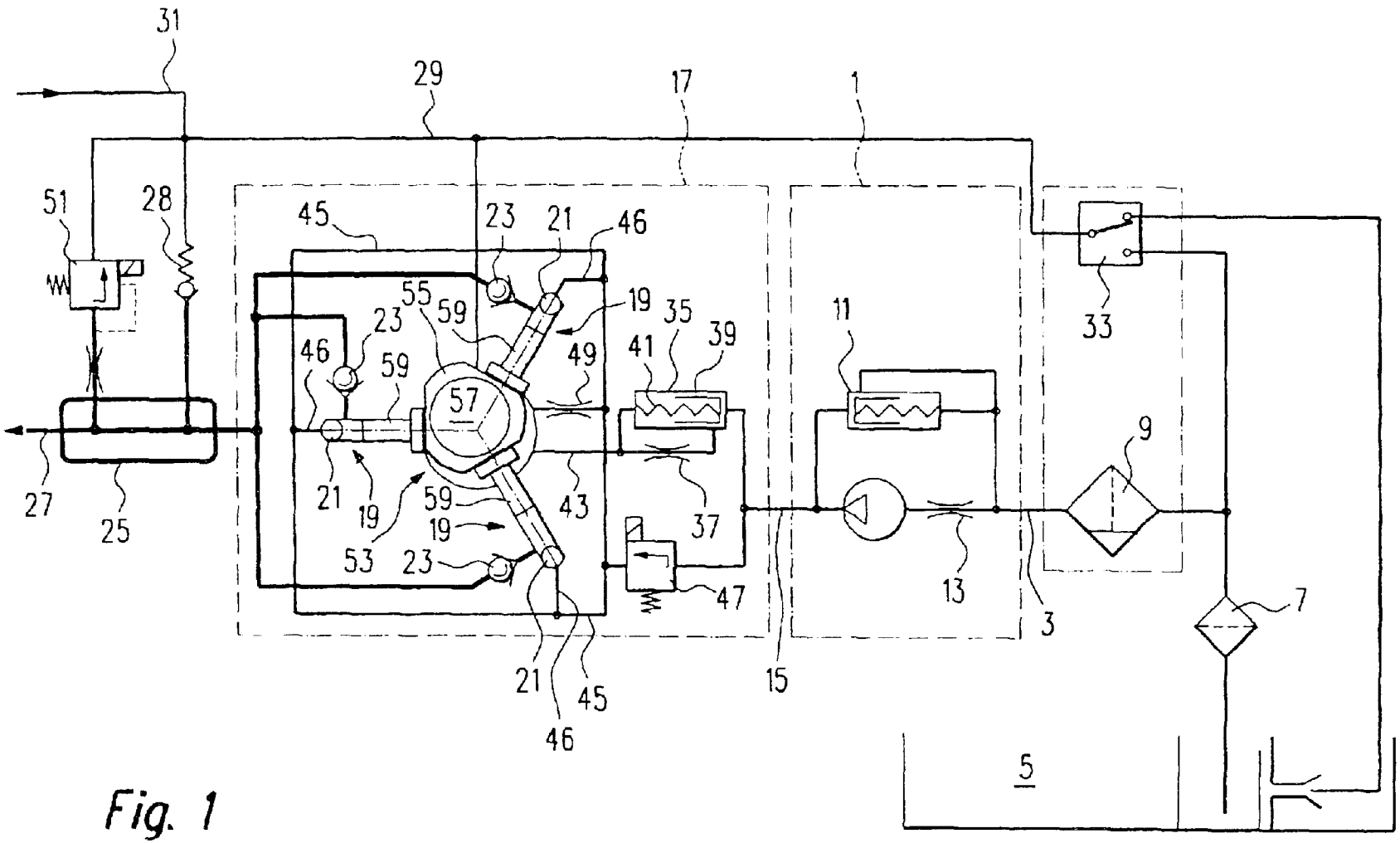
FIG. 1 shows a fuel injection system with one exemplary embodiment of a high-pressure fuel pump of the invention.

In FIG. 1, a common rail injection system of the prior art is shown schematically. A prefeed pump 1, via an inflow line 3, aspirates fuel, not shown, from a tank 5. The fuel is filtered in a prefilter 7 and a filter with a water trap 9.

The prefeed pump 1 is embodied as a geared pump and has a first overpressure valve 11. On the intake side, the prefeed pump is throttled by a first throttle 13. A compression side 15 of the prefeed pump 1 supplies a high-pressure fuel pump 17 with fuel. The high-pressure fuel pump 17 is embodied as a radial piston pump with three pump elements 19, and it drives the prefeed pump. One check valve 21 is provided on the intake side of each of the pump elements 19. On the compression side of the pump elements 19, one check valve 23 each is provided, which prevents the fuel that is at high pressure and that has been pumped by the pump elements 19 into a common rail 25 from flowing back into the pump elements 19.

The lines of the fuel injection system that are under high pressure are shown in FIG. 1 as heavy lines, while the regions of the fuel injection system that are at low pressure are represented by fine lines.

The common rail 25 supplies one or more injectors, not shown in FIG. 1, with fuel via a high-pressure line 27. A second overpressure valve 28, which connects the common rail to a return line 29 as needed, prevents impermissibly high pressures in the high-pressure region of the fuel injection system. Via the return line 29 and a leakage line 31, the leakage and the control quantities of the injector or injectors, not shown, are returned to the tank 5.

Via a switching valve 33, the fuel located in the return line 29 can also be transported into the inflow line 3 of the prefeed pump 1, which reduces the risk of congealing at low temperatures.

The high-pressure fuel pump 17 is supplied with fuel for the pump elements 19 on the one hand and with fuel for lubrication on the other, both by the prefeed pump 1. The fuel quantity used for lubricating the high-pressure fuel pump 17 is controlled via a control valve 35 and a second throttle 37. In the position of the first control valve 35 shown in FIG. 1, the pressure on the compression side 15 of the prefeed pump 1 does not suffice to move a piston 39 of the first control valve 35 counter to the spring force of a spring 41. Consequently, the first control valve 35 is shown closed in FIG. 1. As soon as the pressure on the compression side 15 rises, the piston 19 moves to the left, counter to the force of the spring 41, and opens the line 43. Via the line 43 and the second throttle 37, fuel for lubricating the high-pressure fuel pump 17 flows into the crankcase of the pump.

Via an annular conduit 45 and inlet conduits 46, the high-pressure fuel pump 17 supplies the pump elements 19 with fuel. To regulate the feed quantity of the high-pressure fuel pump 17, a metering valve 47 is provided between the compression side 15 of the prefeed pump 1 and the annular conduit 45. The metering valve 47 is a flow valve, which is triggered by a control unit, not shown, of the fuel injection system. The pump elements 19 are thus throttled on the intake side via the metering valve 47.

A zero-feed throttle 49 prevents the undesired pressure buildup in the annular conduit 45 that is otherwise caused by the leakage quantity of the metering valve 47 during overrunning, that is, when a motor vehicle is driving downhill, for instance. Because of the zero-feed throttle 49, the fuel can flow out of the annular conduit 45 into the crankcase of the high-pressure fuel pump 17, where it can be used to lubricate the high-pressure fuel pump 17.

The pressure in the common rail 25 is regulated via a pressure valve 51, which can also be embodied as a flow valve. The pressure valve 51 is likewise triggered by the control unit, not shown.

The pump elements 19 are driven by a drive shaft 53 with an eccentric element 55. An intermediate ring 57 with three flat faces is thrust onto the eccentric element 55, and the pistons 59 of the pump elements 19 are braced on this ring.

Figure 2:
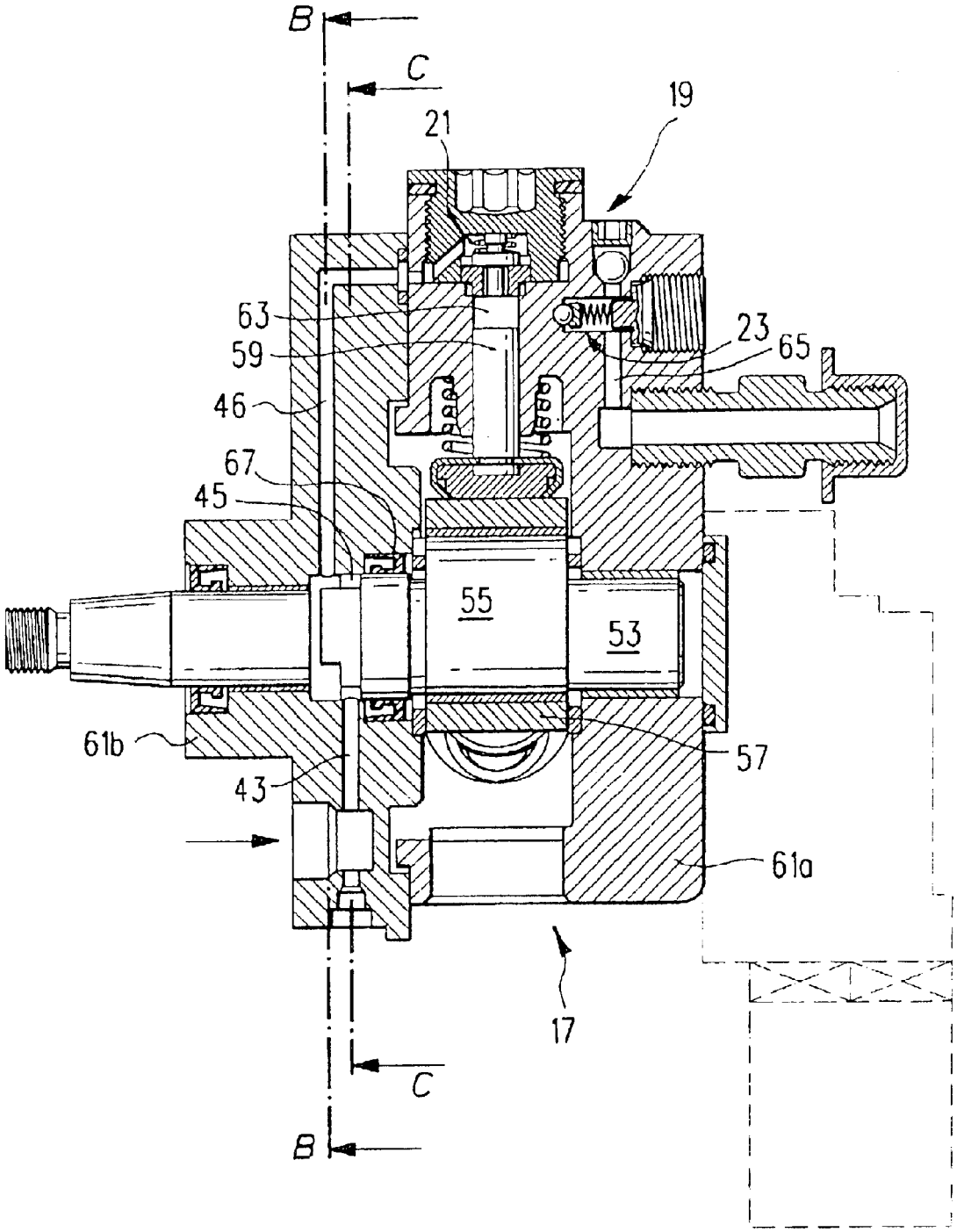
FIG. 2 shows one exemplary embodiment of a high-pressure fuel pump of the invention in longitudinal section.

In FIG. 2, an exemplary embodiment of a high-pressure fuel pump 17 of the invention is shown in longitudinal section. The drive shaft 53 is rotatably supported in a housing 61. This housing 61 is embodied in two parts 61*a* and 61*b*, to simplify both production and assembly. In FIG. 2, one pump element 19 is shown in somewhat greater detail. The intermediate ring 57 transmits an oscillating motion to the piston 59 of the pump element 19 when the drive shaft 53 is set into rotation. The check valve 21, which is disposed in the inlet conduit 46, assures that the piston 59, during the intake stroke, can aspirate fuel from the annular conduit 45 via the inlet conduit 46. On the other hand, the check valve 21 prevents a return flow of fuel from a pumping chamber 63 of the pump element 19 during the pumping stroke.

During the pumping stroke, the piston 59 pumps fuel into a high-pressure conduit 65. This high-pressure conduit 65 communicates hydraulically with the common rail of FIG. 1, not shown in FIG. 2. To prevent a return flow of the fuel from the common rail, not shown, into the pumping chamber 63, a check valve 23 is provided in the high-pressure conduit 65.

Figure 3:
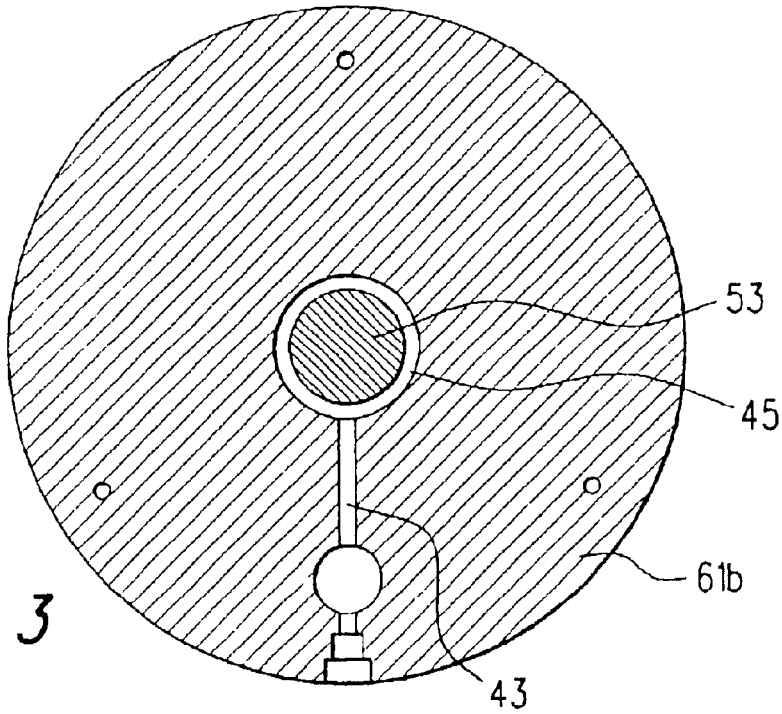
FIG. 3 shows a section taken along the line C—C of FIG. 2.

The annular conduit 45 is defined by the drive shaft 53 and the housing 61*b*. So that fuel from the crankcase, which is formed by the housing part 61*a*, cannot enter the annular conduit 45, a radial shaft sealing ring 67 is provided between the annular conduit 45 and the crankcase. The annular conduit 45 is filled with fuel via a line 43, which in turn communicates with the metering valve 47 (see FIG. 1). FIG. 3 shows a section taken along the line C—C. It can be seen clearly from this view that the annular conduit 45 is defined radially by the drive shaft 53 and the housing 61*b*. The line 43 is also clearly visible in this view.

Figure 4:
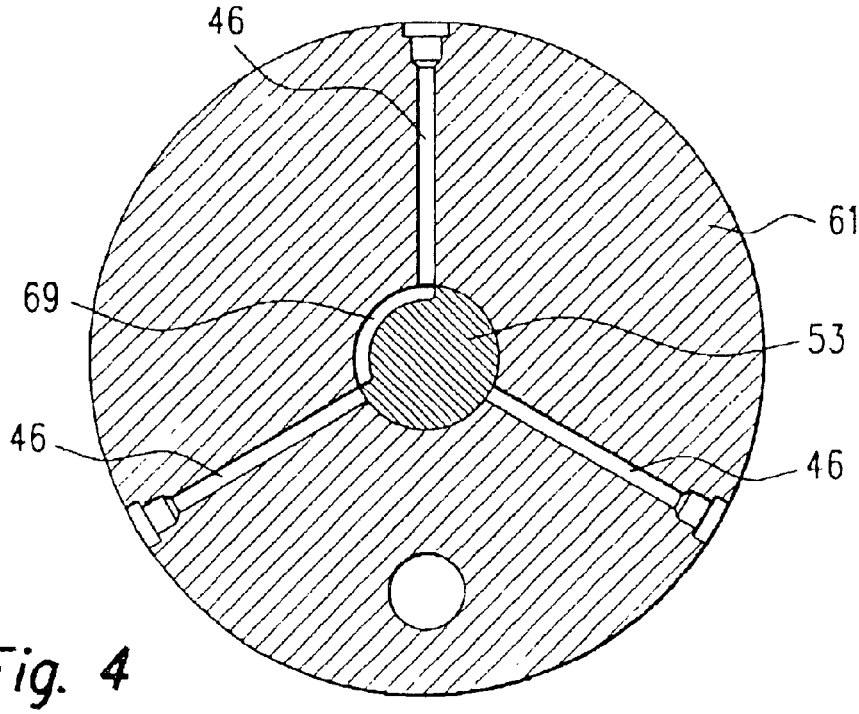
FIG. 4 shows a section taken along the line B—B of FIG. 2.

In FIG. 4, a section taken along the line B—B of FIG. 2 is shown. In this view, it becomes clear that the drive shaft 53 is embodied as a rotary slide in the sectional plane. The drive shaft 53 has a recess 69, which establishes the hydraulic communication between the annular conduit 45 (see FIG. 3) and an inlet conduit 46. In principle, the opening angle of the recess 69 is 360°/n, where n is the number of pump elements 19.

If the opening angle of the recess 69 is less than 360°/n, then a complete hydraulic disconnection of the inlet conduits 46 from one another is achieved.

It may also be appropriate to select the opening angle of recess 69 as greater than 360°/n, so that at least two inlet conduits 46 intermittently communicate with one another via the annular conduit 45. As a result, the feed quantity, for instance, of the prefeed pump (see FIG. 1) can be made more uniform.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A radial piston pump for high-pressure fuel supply n common rail fuel injection systems of internal combustion engines, comprising, a plurality of pump elements (19), disposed radially to a drive shaft (53), each of the pump elements (19) having a pumping chamber (63) that is defined on one end by a piston (59), one intake-side inlet conduit (46) per pump element (19), wherein the inlet conduits (46) are supplied with fuel via an annular conduit (45), defined by the drive shaft (53) and a housing (61), and discharge into the pumping chambers (63) of the pump elements (19), the drive shaft (53) being adapted to directly control the hydraulic communication between the annular conduit (45) and the inlet conduits (46), wherein the inlet conduits (46) are defined by passages formed in the housing (61), wherein during the intake stroke of a pump element (19), this element communicates hydraulically with the annular conduit (45), and wherein, regardless of the position of the drive shaft (53), only one inlet conduit (19) communicates hydraulically with the annular conduit (45).

2. The radial piston pump of claim 1 wherein the fuel inflow in the annular conduit (45) is controlled by a metering unit (47).

3. The radial piston pump of claim 1 further comprising a check valve (21) disposed in each inlet conduit (46).

4. A radial piston pump for high-pressure fuel supply in common rail fuel injection systems of internal combustion engines, comprising, a plurality of pump elements (19), disposed radially to a drive shaft (53), each of the pump elements (19) having a pumping chamber (63) that is defined on one end by a piston (59), one intake-side inlet conduit (46) per pump element (19), wherein the inlet conduits (46) are supplied with fuel via an annular conduit (45), defined by the drive shaft (53) and a housing (61), and discharge into the pumping chambers (63) of the pump elements (19), the drive shaft (53) being adapted to directly control the hydraulic communication between the annular conduit (45) and the inlet conduits (46), wherein the inlet conduits (46) are defined by passages formed in the housing (61), wherein the drive shaft (53) is embodied as a rotary slide valve, wherein during the intake stroke of a pump element (19), this element communicates hydraulically with the annular conduit (45) and wherein, regardless of the position of the drive shaft (53), only one inlet conduit (19) communicates hydraulically with the annular conduit (45).

5. The radial piston pump of claim 4 wherein the fuel inflow in the annular conduit (45) is controlled by a metering unit (47).

6. A radial piston pump for high-pressure fuel supply in common rail fuel injection systems of internal combustion engines, comprising, a plurality of pump elements (19), disposed radially to a drive shaft (53), each of the pump elements (19) having a pumping chamber (63) that is define on one end by a piston (59), one intake-side inlet conduit (46) per pump element (19), wherein the inlet conduits (46) are supplied with fuel via an annular conduit (45), defined by the drive shaft (53) and a housing (61), and discharge into the pumping chambers (63) of the pump elements (19), the drive shaft (53) being adapted to directly control the hydraulic communication between the annular conduit (45) and the inlet conduits (46), wherein the inlet conduits (46) are defined by passages formed in the housing (61), wherein during the intake stroke of a pump element (19), this element communicates hydraulically with the annular conduit (45), and wherein, regardless of the position of the drive shaft (53), at least one inlet conduit (19) does not communicate hydraulically with the annular conduit 45).

7. The radial piston pump of claim 6 wherein the fuel inflow in the annular conduit (45) is controlled by a metering unit (47).

8. The radial piston pump of claim 6 further comprising a check valve (21) disposed in each inlet conduit (46).

9. A radial piston pump for high-pressure fuel supply in common rail fuel injection systems of internal combustion engines, comprising, a plurality of pump elements (19), disposed radially to a drive shaft (53), each of the pump elements (19) having a pumping chamber (63) that is define on one end by a piston (59), one intake-side inlet conduit (46) per pump element (19), wherein the inlet conduits (46) are supplied with fuel via an annular conduit (45), defined by the drive shaft (53) and a housing (61), and discharge into the pumping chambers (63) of the pump elements (19), the drive shaft (53) being adapted to directly control the hydraulic communication between the annular conduit (45) and the inlet conduits (46), wherein the inlet conduits (46) are defined by passages formed in the housing (61), wherein the drive shaft (53) is embodied as a rotary slide valve, wherein during the intake stroke of a pump element (19), this element communicates hydraulically with the annular conduit (45) and wherein, regardless of the position of the drive shaft (53), at least one inlet conduit (19) does not communicate hydraulically with the annular conduit (45).

10. The radial piston pump of claim 9 wherein the fuel inflow in the annular conduit (45) is controlled by a metering unit (47).

11. A radial piston pump for high-pressure fuel supply in common rail fuel injection systems of internal combustion engines, comprising, a plurality of pump elements (19), disposed radially to a drive shaft (53), each of the pump elements (19) having a pumping chamber (63) that is defined on one end by a piston (59), one intake-side inlet conduit (46) per pump element (19), wherein the inlet conduits (46) are supplied with fuel via an annular conduit (45), defined by the drive shaft (53) and a housing (61), and discharge into the pumping chambers (63) of the pump elements (19), the drive shaft (53) being adapted to directly control the hydraulic communication between the annular conduit (45) and the inlet conduits (46), wherein the inlet conduits (46) are defined by passages formed in the housing (61), and wherein during the intake stroke of a pump element (19), the inlet conduit (46) associated with the pump element communicates hydraulically with the annular conduit (45) and during the pumping stroke of the pump element (19), the inlet conduit (46) associated with the pump element (19) is disconnected from the annular conduit (45) by the drive shaft.

12. The radial piston pump of claim 11 wherein the drive shaft (53) is embodied as a rotary slide valve.

13. The radial piston pump of claim 12 further comprising a check valve (21) disposed in each inlet conduit (46).

14. The radial piston pump of claim 11 further comprising a check valve (21) disposed in each inlet conduit (46).

15. The radial piston pump of claim 11 wherein the inlet conduits (46) extend essentially radially to the longitudinal axis of the drive shaft (53).

16. A radial piston pump for high-pressure fuel supply in common rail fuel injection systems of internal combustion engines, comprising, a plurality of pump elements (19), disposed radially to a drive shaft (53), each of the pump elements (19) having a pumping chamber (63) that is define on one end by a piston (59), one intake-side inlet conduit (46) per pump element (19), wherein the inlet conduits (46) are supplied with fuel via an annular conduit (45), defined by the drive shaft (53) and a housing (61), and discharge into the pumping chambers (63) of the pump elements (19), the drive shaft (53) being adapted to directly control the hydraulic communication between the annular conduit (45) and the inlet conduits (46), wherein the inlet conduits (46) are defined by passages formed in the housing (61), further comprising a check valve (21) disposed in each inlet conduit (46), and wherein the annular conduit (45) is sealed off from the lubrication of the high-pressure fuel pump.

17. The radial piston pump of claim 16 further comprising a check valve (21) disposed in each inlet conduit (46).

* * * * *